United States Patent [19]

Martin et al.

[11] Patent Number: 4,523,898

[45] Date of Patent: Jun. 18, 1985

[54] HYDRAULIC WOBBLE PUMPS

[75] Inventors: Paul H. Martin; John C. Martin, both of Toronto, Canada

[73] Assignee: Diesel Equipment Limited, Toronto, Canada

[21] Appl. No.: 569,616

[22] Filed: Jan. 10, 1984

[51] Int. Cl.[3] ..... F01B 31/00; F01B 1/18

[52] U.S. Cl. ..... 417/269; 92/128

[58] Field of Search ..... 417/269, 271; 92/128

[56] References Cited

U.S. PATENT DOCUMENTS

| | | | |
|---|---|---|---|
| 2,382,263 | 8/1945 | Schwell | 417/269 |
| 2,392,543 | 1/1946 | Mercier | 417/269 |
| 2,713,829 | 7/1955 | Beacham | 417/269 |
| 2,940,323 | 6/1960 | Cousins et al. | 417/269 |
| 2,972,955 | 2/1961 | Richter et al. | 417/271 |
| 3,295,457 | 1/1967 | Oram | 417/271 |
| 3,663,122 | 5/1972 | Kitchen | 417/269 |
| 4,004,863 | 1/1977 | Porel | 417/271 |
| 4,105,369 | 8/1978 | McClocklin | 417/269 |
| 4,392,787 | 7/1983 | Notta | 417/269 |

FOREIGN PATENT DOCUMENTS

| | | | |
|---|---|---|---|
| 297542 | 3/1954 | Switzerland | 417/269 |
| 955139 | 9/1960 | United Kingdom | 417/269 |
| 1385886 | 3/1975 | United Kingdom | 417/269 |

*Primary Examiner*—William L. Freeh

*Attorney, Agent, or Firm*—Fetherstonhaugh & Co.

[57] ABSTRACT

An hydraulic wobble pump having an inlet passage extending inwardly from one end thereof through the central portion of said housing and opening into said wobble chamber. The inlet passage being arranged to admit hydraulic fluid to said wobble chamber substantially centrally between said cylinders so as to be substantially uniformly distributed to each cylinder in use.

2 Claims, 4 Drawing Figures

HYDRAULIC WOBBLE PUMPS

This invention relates to hydraulic wobble pumps. In particular, this invention relates to improvements in wobble pumps which permit even distribution of the incoming hydraulic fluid to the various cylinders of the pump and facilitate the removal of the power transmission gearing.

PRIOR ART

Hydraulic wobble pumps are used extensively as a hydraulic pump which is driven from the power take-off of a motor vehicle such as a truck. Conventionally, the input passage through which hydraulic fluid is admitted to the wobble chamber extends laterally through a side wall of the pump housing. This configuration prevents even distribution of hydraulic fluid to each of the cylinders of the pump and this results in uneven wear in the pump and an uneven discharge of hydraulic fluid from the pump.

Furthermore, in the prior wobble pumps, the discharge passages which open from the cylinders to the manifold which communicates with the outlet passage are angularly inclined with respect to their associated cylinder so as to converge in a direction toward the manifold and this results in restriction of the flow of hydraulic fluid from the cylinders to the outlet passage.

Consequently, the overall efficiency of the known wobble pumps is no greater than 60% of the theoretical maximum.

The gearing of the power transmission system of a conventional wobble pump must be selected so as to mate with the power take-off of various different vehicles with the result that it is frequently necessary to change the gearing to match that of the power take-off system which is to be used to drive the pump. Considerable difficulty has been experienced by mechanics in the field in attempting to remove the transmission gears from the known wobble pump assemblies because of the fact that it is necessary to substantially completely disassemble the pump in order to remove the transmission gears.

To overcome the difficulty which has previously been experienced with the uneven distribution of hydraulic fluid to the various cylinders of the wobble pump, I form the inlet passage to the wobble pump, so that it extends from an outer end of the housing through a central portion of the housing to open into the wobble cylinder substantially centrally between the cylinders.

To permit discharge of the pressurized hydraulic fluid from the same end of the housing as that through which hydraulic fluid is admitted to the housing, I provide a manifold chamber extending circumferentially of and spaced outwardly from the inlet passage, the manifold passage communicating with the discharge passages of the various cylinders and having an outlet passage which opens therefrom and which is spaced radially outwardly from the inlet passage.

To overcome the difficulties previously experienced resulting from the converging discharge passages from the various cylinders, I arrange the discharge passages so that they extend in alignment with their associated cylinders and discharge into a manifold chamber which is arranged to receive the discharge.

SUMMARY OF INVENTION

According to one aspect of the present invention, there is provided in a wobble pump, a housing which has first and second oppositely disposed outer ends, a wobble plate mounted for movement in a wobble chamber formed in said housing, a plurality of pistons slidably mounted in cylinders formed in said housing and extending longitudinally from said wobble chamber to said first outer end of said housing at circumferentially spaced intervals about the periphery of a central portion of said housing, the improvement of; an inlet passage extending inwardly from said first outer end through said central portion of said housing and opening into said wobble chamber, said inlet passage being arranged to admit hydraulic fluid to said wobble chamber substantially centrally between said cylinders so as to be substantially uniformly distributed to each cylinder in use.

According to a further aspect of the present invention there is provided in a hydraulic pump of the type described above which has a power transmission shaft mounted in a power transmission compartment of said housing for rotation about a first axis which extends longitudinally of said housing, the further improvement of; an end plate removably mounted at said second outer end of said housing, said end plate being removable to permit removal of said power transmission shaft from said housing along said first axis, and wherein, said inlet passage is aligned with said first axis to an extent sufficient to permit a power transmission shaft removal tool to be driven therethrough to provide a shaft removal axial impact to the power transmission shaft in a direction toward said second outer end to assist in the removal of the power transmission shaft from the housing.

According to yet another aspect of the present invention, there is provided in an hydraulic wobble pump of the type described above, the further improvement of an hydraulic fluid outlet comprising; a manifold chamber extending circumferentially of and spaced outwardly from said inlet passage, said cylinders each having a discharge passage opening into said manifold chamber, and, an outlet passage opening from said manifold chamber at said first outer end of said chamber, said outlet passage being spaced radially outwardly from said inlet passage.

According to yet another aspect of the present invention, there is provided in an hydraulic wobble pump of the type described above the improvement wherein the housing comprises a pump housing which houses said cylinders and a transmission housing which houses said transmission shaft, said pump housing and transmission housing having oppositely disposed inner ends which are adapted to mate with one another to be secured in an end to end relationship forming said wobble chamber therebetween.

PREFERRED EMBODIMENT

The invention will be more clearly understood after reference to the following detailed specification read in conjunction with the drawings wherein.

Figure 1:
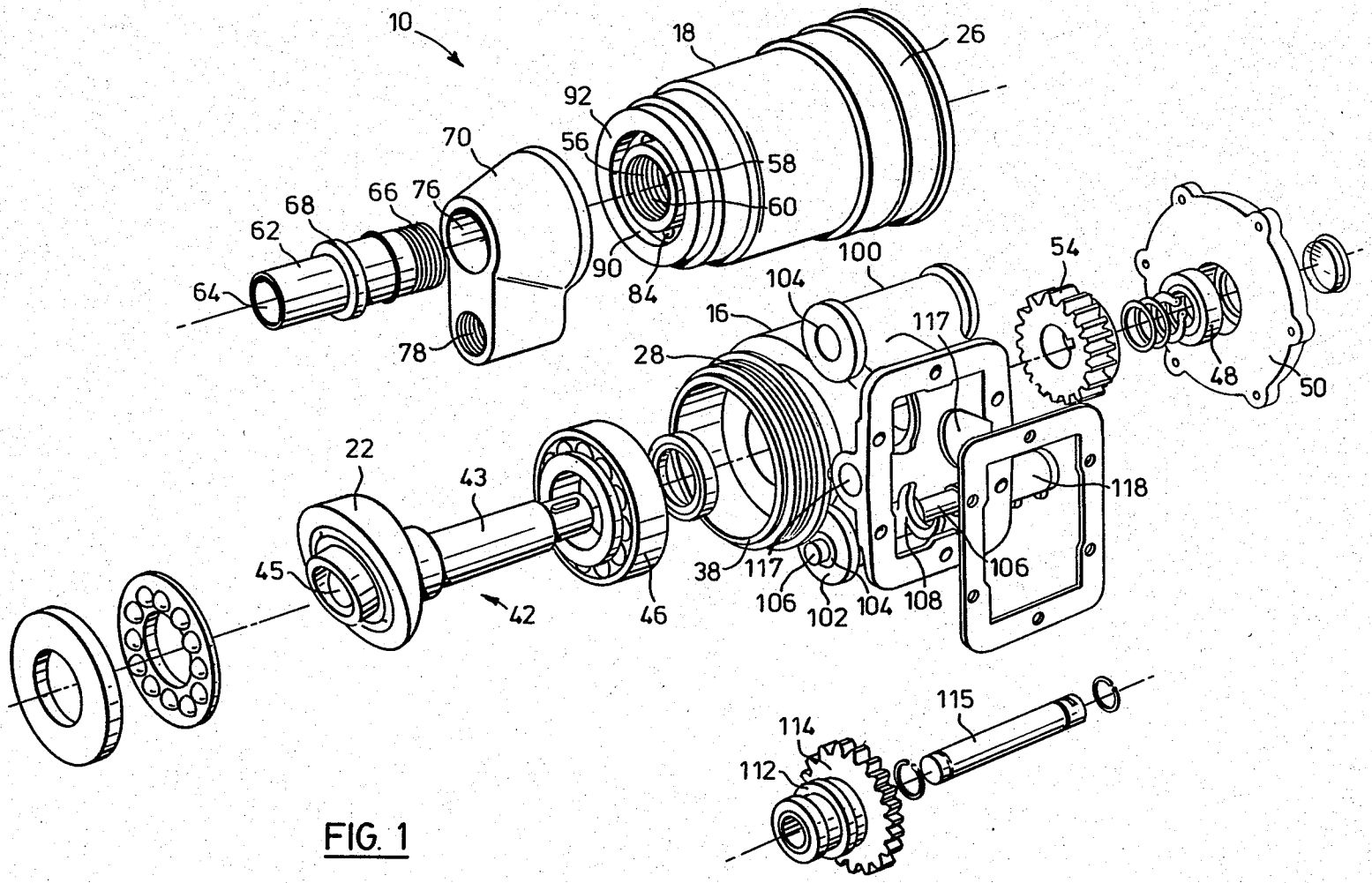
FIG. 1 is an exploded view of an hydraulic wobble pump constructed in accordance with an embodiment of the present invention.

With reference to the drawings, the reference numeral 10 refers generally to an hydraulic wobble pump constructed in accordance with an embodiment of the present invention.

Figure 2:
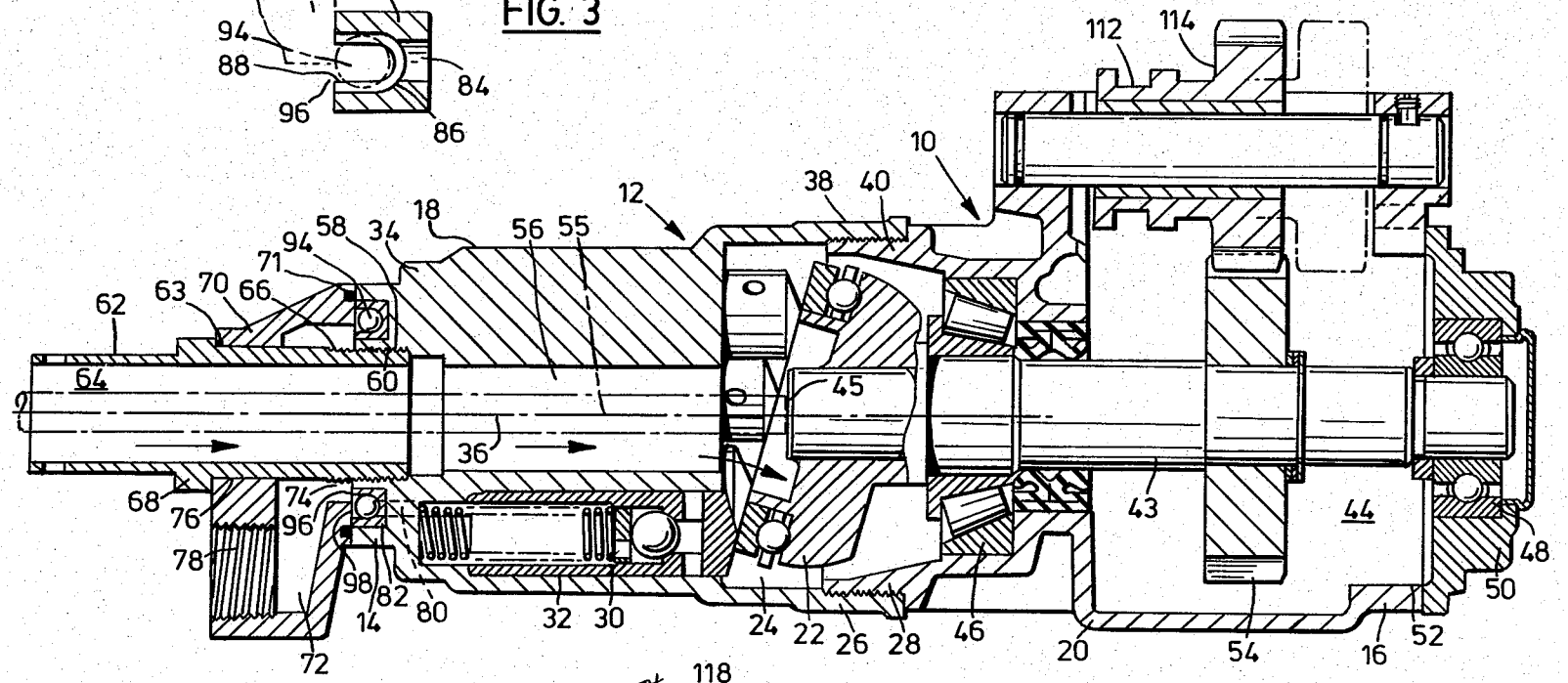
FIG. 2 is a longitudinal sectional view of the assembled wobble pump of FIG. 1.
Figure 3:
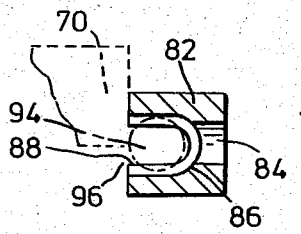
FIG. 3 is an enlarged sectional side view of a ball valve seat at the discharge end of the vpump cylinders.

With reference to FIG. 2 of the drawings, the reference numeral 12 refers generally to a pump housing assembly which has a first outer end 14 and a second outer end 16 oppositely disposed.

With reference to FIGS. 1 and 2, it will be seen that housing assembly 12 comprises a pump housing 18 and a power transmission housing 20. A wobble plate 22 of a conventional construction is mounted for rotation in a wobble chamber 24 which is formed between the inner ends 26 and 28 of the pump housing 18 and power transmission housing 30 respectively.

A plurality of piston assemblies 30 are slidably mounted in cylinders 32 which are formed in the pump housing 18 and extend longitudinally from the wobble chamber 24 at circumferentially spaced intervals about the periphery of a circle generated from the longitudinal axis 36.

The pump housing 18 and the transmission housing 20 have threaded inner ends 38 and 40 which are adapted to mate with one another to form the wobble chamber 24 therebetween. This arrangement simplifies the manufacture of the two housing and makes the pump easy to install because there are no lateral projections which might form obstructions in the environment in which the pump is to operate.

The pump housing 18 is formed with an inlet passage 56 which opens through the central portion 34 of the pump housing and communicates at one end with the wobble chamber 24. The inlet passage 56 is axially aligned with the longitudinal axis 36 about which the wobble plate 22 is rotatably driven in use by means of the power transmission shaft 42 to which it is connected.

A wobble shaft assembly 42 (FIG. 2) consists of a shaft 43 and the wobble plate 22. The shaft 43 is mounted in the power transmission compartment 44 for rotation about the longitudinal axis 36. One end of the shaft 43 is mounted in the bearing 46 and the other end is mounted in a bearing 48 which is supported by a removable end plate 50. When the end plate 50 is removed, the service 52 which is formed at the second outer end 16 of the housing assembly 12, is sufficiently large to permit the the gear 54 to be removed therethrough. When a new gear 54 is to be driven onto the shaft 43, a back up or anvil rod 55 may be arranged to extend through the passage 56 to bear against the end face 45 of the shaft 43. If it is necessary to remove the wobble shaft assembly, the anvil rod 55 may be driven against the end face 45. The passage 56 does therefore facilitate mounting and removal of gear 54 and the wobble shaft assembly.

The inlet passage 56 has a portion 58 of enlarged diameter located at the outer end thereof. The portion 58 is formed with a threaded section 60.

A tubular member 62 has a through passage 64 formed therein. The threaded inner end 66 of the tubular member 62 is mounted in the threaded section 60 of the portion 58 of the inner passage 56 of the housing and is axially aligned with the longitudinal axis 36. The tubular member 62 is formed with an annular shoulder 68 which projects radially therefrom.

A manifold 70 is formed with a manifold chamber 72 which has an open end 74. An O ring 71 is formed in a channel which extends circumferentially about the open end 74 and serves to seal the manifold 70 with respect to the pump housing 18. A mounting passage 76 opens from the manifold chamber 72 and is arranged to axially aligned with the longitudinal axis 36. The tubular member 62 is mounted in the passage 76 and has its shoulder 68 bearing against an O-ring 63 which is seated in a channel formed in the outer end face of the manifold 70 which encircles the open end 74. The manifold chamber 72 also has an outlet passage 78. The outlet passage 78 is threaded to receive a threaded coupling of a hydraulic fluid conduit for use in transporting the hydraulic fluid under pressure from the pump. The outlet passage 78 is spaced radially outwardly from the longitudinal axis 36.

Each of the cylinders 32 is formed with a discharge passage 80. The outer end of each discharge 80 is recessed and houses a hardened metal sleeve 82. Each metal sleeve 82 (FIG. 2) is cylinderical in shape and has a through passage 84 which is aligned with the through passage 80. A concave seat 86 is formed at the outer end of each insert 82 and an arcuate shaped notch 88 opens laterally from the seat 86 at opposite sides thereof. An annular channel 90 (FIG. 1) extends about the end face 92 of the pump housing 18 and communicates with the through passage 84 of each insert 82. A hardened steel ball 94 is mounted in each concave seat 86 of each insert 82. An annular passage 96 communicates between the channel shaped recess 90 and the manifold chamber 72. The balls 94 are proportioned so as to be movable away from the seat 86 into engagement with the shoulder 98 of the manifold 70 a sufficient distance to permit the free discharge of fluid from the passages 78 through the passage 96 into the manifold chamber 72. The balls 94 are, however, retained sufficiently closely adjacent the open end of the passages 80 so as to be drawn into a seating sealing engagement with the seats 86 when a negative pressure is generated in the associated passage 80.

Figure 4:
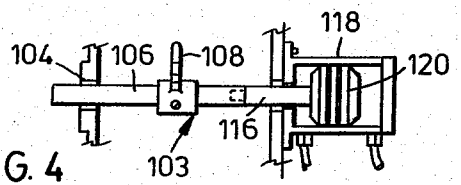
FIG. 4 is a partially sectioned side view of a gear shaft mechanism suitable for use in shifting gears of a wobble pump.

A further feature of the pump of the present invention, is that the power transmission housing 16 is adapted to provide two mountings, 100 and 102, either of which may be used for the purposes of mounting the gear change mechanism 103 (FIG. 4). The mountings 100 and 102 each have a through passage 104. A shaft 106 may be mounted in either one of the passages 104. The shaft 106 supports a yoke 108 which has arms 110 which are adapted to extend into the slot 112 of the movable power transmission gear 114 which is slidably mounted on shaft 115 which is in turn mounted in passages 117 of the housing 16. The shaft 104 has its outer end connected to a piston rod 116 (FIG. 4) of a pneumatic cylinder 118 in which piston 120 is mounted to reciprocate.

By activating the pneumatic cylinder 118, the piston 120 may be displaced to cause the shaft 106 to be axially displaced thereby displacing the yoke 108 which in turn displaces the transmission gear 114 to effect a gear change as required in use. The advantage of the provision of two alternative mounting points for the gear change mechanism is that the most convenient location can be selected to provide ease of access to the gear change mechanism in each installation.

These and other advantages of the present invention will be apparent to those skilled in the art.

I claim:

1. In an hydraulic wobble pump having, a housing assembly which has first and second oppositely disposed outer ends, a wobble chamber and a power transmission chamber formed in said housing, a wobble shaft mounted for rotation in said housing and extending into said wobble and power transmission chambers, said wobble shaft having an inner end located in said wobble chamber, a power transmission gear removably mounted on said wobble shaft and located in said power transmission chamber, a plurality of pistons slidably mounted in cylinders formed in said housing and extending longitudinally from said wobble chamber to said first outer end of said housing at circumferentially spaced intervals about the periphery of a central portion of said housing, the improvement of;

(a) a service passage formed at said second end of said housing and opening into said power transmission chamber, said passage being proportioned to permit said power transmission gear to pass therethrough when being mounted on or removed from the wobble shaft when it is located in said power transmission chamber, (b) an end plate removably mounted at said second outer end of said housing for closing said service passage, (c) a fluid inlet passage extending inwardly from said first outer end through said central portion of said housing and opening into said wobble chamber directly opposite said inner end of said wobble shaft to permit an anvil shaft to extend therethrough to provide a support which will support the wobble shaft when said power transmission gear is being mounted on wobble shaft when it is located in said housing.

2. In an hydraulic wobble pump having, a housing which has first and second oppositely disposed outer ends, a wobble plate mounted for movement in a wobble chamber formed in said housing, a plurality of pistons slidably mounted in cylinders formed in said housing and extending longitudinally from said wobble chamber to said first outer end of said housing at circumferentially spaced intervals about the periphery of a central portion of said housing, each piston having an inner end which projects into the wobble chamber and has an intake passage formed therein for admitting hydraulic fluid from the wobble chamber to each cylinder through its associated piston, each cylinder having a discharge passage at said first outer end of said housing, the improvement of;

(a) an inlet passage extending inwardly from said first outer end through said central portion of said housing and opening into said wobble chamber, said inlet passage being arranged to admit hydraulic fluid to said wobble chamber substantially centrally between said cylinders so as to be substantially uniformly distributed to each cylinder in use, said inlet passage having a threaded outer end at said first outer end of said housing, (b) an outlet manifold having a mounting passage opening therethrough which is alinged with said inlet passage of said housing, (c) a tubular manifold mounting member extending through said mounting passage of said manifold and threadedly mounted in said threaded outer end of said inlet passage, said tubular manifold mounting member being adapted to releasably secure said outlet manifold with respect to said housing, (d) a manifold chamber formed in said outlet manifold, said manifold chamber having an inlet opening communicating with the discharge passages of said cylinders, said manifold chamber extending circumferentially of and being spaced outwardly from said tubular mounting member, (e) an outlet passage opening from said manifold chamber, said outlet passage being spaced radially outwardly from said inlet passage, (f) said outlet manifold being freely rotatable about said tubular manifold mounting member when said tubular manifold mounting member is released from clamping engagement therewith to permit said outlet passage to be located at any convenient circumferential position about said tubular manifold mounting member for connection to an output line.

* * * * *